United States Patent [19]

Bejarano et al.

[11] 4,064,589

[45] Dec. 27, 1977

[54] DOOR CLOSER

[75] Inventors: Thomas M. Bejarano, Hacienda Heights, Calif.; Herbert Schmidt, Sauerlandst, Germany; Joseph J. Schmidt, Torrance, Calif.

[73] Assignee: Builders Brass Works, Los Angeles, Calif.

[21] Appl. No.: 668,228

[22] Filed: Mar. 18, 1976

[51] Int. Cl.[2] ..... E05F 3/22

[52] U.S. Cl. ..... 16/53; 16/60

[58] Field of Search ..... 16/53, 60

[56] References Cited

U.S. PATENT DOCUMENTS

| | | | |
|---|---|---|---|
| 1,177,642 | 4/1916 | Lonbom et al. | 16/55 |
| 1,833,121 | 11/1931 | Norton | 16/56 X |
| 2,700,175 | 1/1955 | Carlson | 16/55 |
| 3,246,362 | 4/1966 | Jackson | 16/51 |
| 3,724,023 | 4/1973 | Tillmann | 16/53 |

FOREIGN PATENT DOCUMENTS

| | | | |
|---|---|---|---|
| 2,427,114 | 12/1975 | Germany | 16/53 |
| 2,161,293 | 6/1973 | Germany | 16/53 |
| 2,000,731 | 12/1970 | Germany | 16/53 |
| 1,807,399 | 5/1970 | Germany | 16/53 |
| 1,221,422 | 2/1971 | United Kingdom | 16/53 |

*Primary Examiner*—Werner H. Schroeder
*Assistant Examiner*—Conrad L. Berman
*Attorney, Agent, or Firm*—Lyon & Lyon

[57] ABSTRACT

Disclosed herein is a device for closing swinging doors which is mounted in a door frame and has an elongated housing with a spindle rotatably mounted in one end thereof by which the door closer is secured to a door. A cylinder is interiorly formed in the other end of the housing and has a piston disposed therein. The piston rod extends from the cylinder and is secured at its extended end to a pair of flat carrier plates which are slidably mounted within the housing about the spindle and biased to maintain the door in a closed position. Camming surfaces are carried by the spindle which cooperate with a pair of cam followers carried by the carrier plates to hold the door in an open position. Valve means communicating with the cylinder are provided to permit fluid flow from one end of the cylinder to the other about the piston for controlling the rate of travel of the piston within the cylinder and thereby regulate the rate of movement of the door as it is being opened, closed and latched.

19 Claims, 15 Drawing Figures

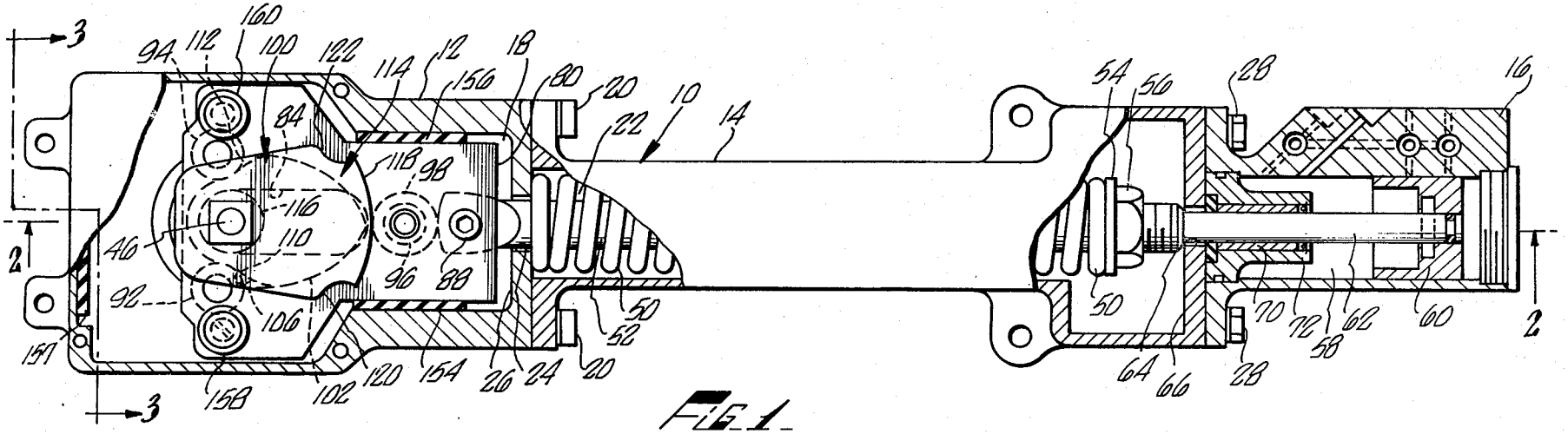
FIG. 1
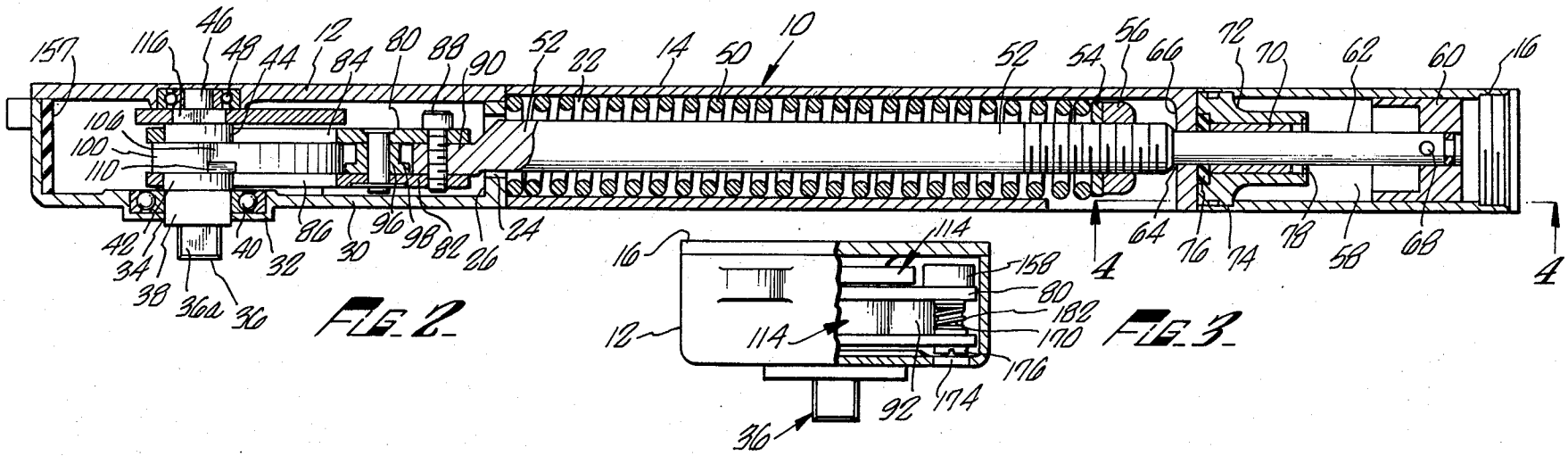
FIG. 2
FIG. 3

DOOR CLOSER

BACKGROUND OF THE INVENTION

There are currently available several types of door closing mechanisms which both urge the door to a closed position and slow the closed speed of the door to prevent the door from slamming into the door frame under the force of the closing mechanism. Generally, however, these devices are quite limited in their durability and function. Some lighterweight devices include means for holding the door in the open or partially open position but provide little else in the way of door opening and closing control and are operative to allow the door to be opened in only one direction. U.S. Pat. No. 3,246,362 teaches a mechanism which can be used on double swinging doors; is capable of holding heavier doors in the open position and includes means for independently regulating the rate at which the door closes and latches. While this device was an improvement over door closers previously available, it would also be a desirable feature to be able to readily adjust the force which must be overcome to open the door while independently being able to regulate the closing and latching speed. Additionally, it would be beneficial to be able to selectively disengage any mechanism which holds the door in the open position while being able to regulate the rate at which the door opens and thereby effectively provide an adjustable shock absorber within the closing mechanism.

Another shortcoming with double swinging door closing mechanisms presently available, including that identified above, is their need for the operative elements to be immersed in oil or other hydraulic fluid, thereby necessitating the use of an oil seal about the rotating shaft or spindle. Such a seal is highly subject to leakage which constitutes a safety hazard and can, of course, have a very damaging effect on any carpet below. It would be highly desirable to provide a heavy duty door closing mechanism which mounts the spindle in a dry sump and thereby eliminate the need for such a seal. As will be described, the door closer described herein includes each of the foregoing beneficial features.

SUMMARY OF THE INVENTION

Briefly, the present invention comprises an improved door closer for double swinging doors of the spring actuated, hydraulic pot type, having improved valving means for the hydraulic fluid for independently controlling the speed of opening, closing and latching of the door. The door closer also includes a dual camming assembly which is carried by the pivot or spindle member and coordinates the rotation of the spindle member, caused by the movement of the door, with the valving mechanism; the camming assembly being selectively operable to hold the door in an open position.

The primary object of the present invention is to provide a novel and improved form of door closer for double swinging doors of the spring actuated, hydraulic cam roller and follower type.

A further object of the present invention is to provide a novel door closer of simple and compact construction and adapted to be positioned and concealed in the header or overhead portion of the door frame.

Another object of the present invention is to provide a door closer which include means for independently controlling the speed of the opening, closing and latching of the door.

Still another object of the present invention is to provide a door closer of the spring actuated, hydraulic cam roller and follower type which utilizes a dry sump to eliminate the need for an oil seal on the rotating shaft.

Yet another object of the present invention is to provide an improved door closer of the spring actuated, hydraulic cam roller and follower type which includes an adjustable hydraulic shock absorber for opening of the door.

Other objects and advantages of the present invention will become apparent from the following detailed description of the preferred embodiments thereof, taken in conjunction with the accompanying drawings.

IN THE DRAWINGS

FIG. 1 is a top plan view of the door closer with portions of the housing partly broken away, illustrating elements of the closer in the door closed position.

FIG. 2 is a sectional view of the door closer taken along line 2—2 of FIG. 1.

FIG. 3 is a sectional view of the door closer taken along line 3—3 of FIG. 1.

Figures 4, 5, 6, 7, 8, 9, 10, 11:
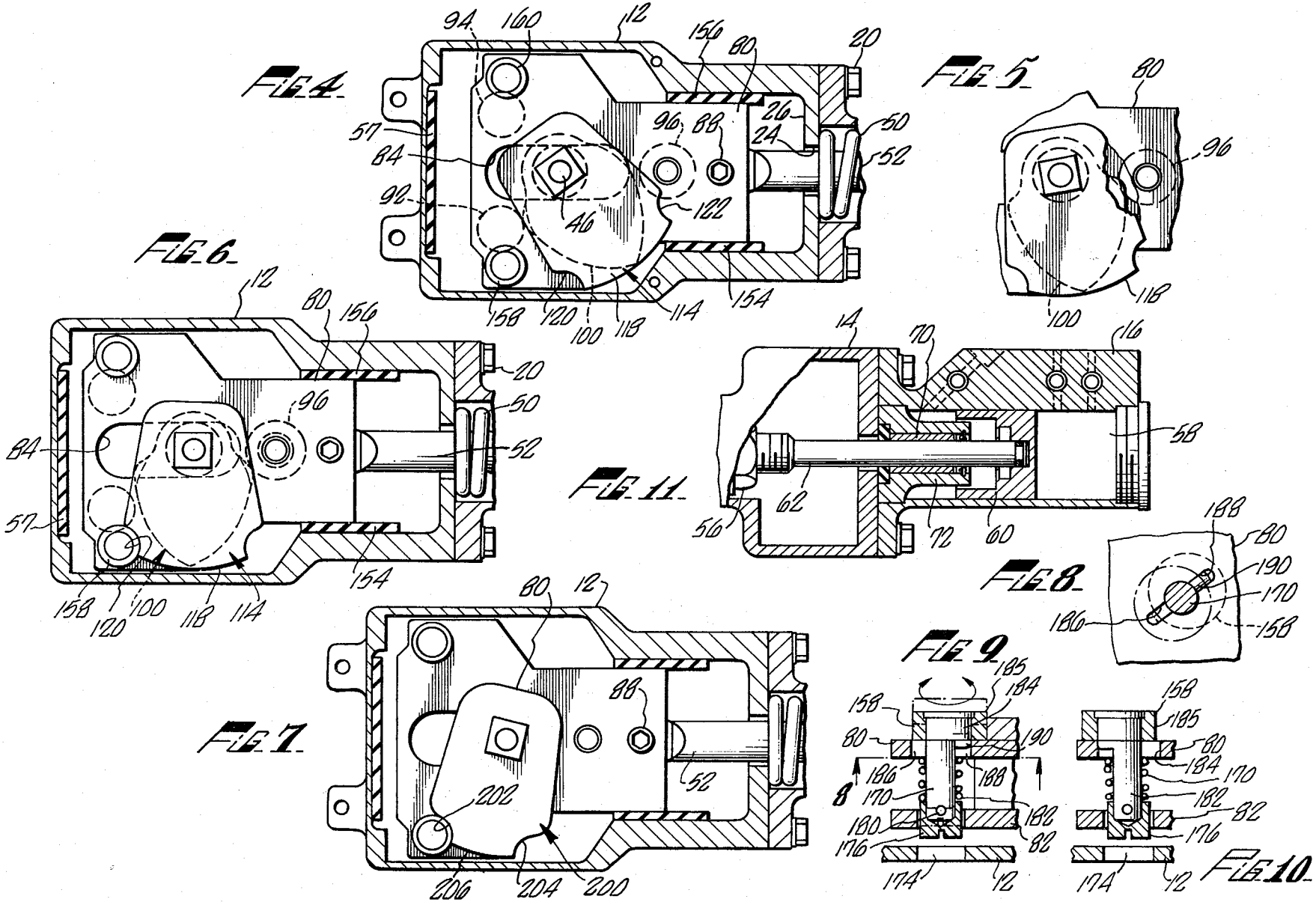
FIG. 4 is a sectional view of a portion of the door closer illustrating the positioning of the elements thereof when the door is partially open.
FIG. 5 is a sectional view of a portion of the door closer illustrating the positioning of the cams and containment roller when the door is partially open.
FIG. 6 is a sectional view of a portion of the door closer illustrating the positioning of the cams when the door is fully open at 90° with respect to the door frame.
FIG. 7 is a sectional view of a portion of the door closer illustrating a second embodiment of the hold-open cam.
FIG. 8 is a sectional view of the hold-open selector taken along lines 8—8 in FIG. 9.
FIG. 9 is a sectional view of the hold-open selector taken along lines 9—9 in FIG. 1.
FIG. 10 is a sectional view of the hold-open selector in the open position.
FIG. 11 is a partial sectional view of a portion of the door closer illustrating the positioning of the piston while the door is partially open.

Referring now in detail to the drawings, the door closer of the present invention is generally designated 10 and is comprised of a cam housing portion 12, central spring housing portion 14 and valve housing 16. The cam housing 12 has an interior chamber 18 therein and is secured to the central housing 14 by threaded fastening members 20, such that the elongated chamber 22 within the central housing 14 communicates with the internal chamber 18 in the cam housing through an opening 24 in the end wall 26 of the cam housing. The central spring housing 14 is secured at its other end to the valve housing 16 by means of threaded fastening means 28, as seen in FIG. 1.

The bottom wall 30 of the cam housing 13 is provided with a boss 32 with a central opening 34. Extending through the opening is the spindle or door pivot member 36, this member having a noncircular end portion 36a for attachment to a door, such as for reception in a noncircular hole in the upper end of the door [not shown]. The member 36 also includes a cylindrical portion 38, journaled in the ball bearing 40, a pair of shoulder or collar portions 42 and 44, and an end cylindrical portion 46, journaled in ball bearing 48, as seen in FIG. 2.

The door closer is provided with a coil spring 50 which is disposed within the central housing 14 about a connecting rod 52. One end of the spring bears against the end wall 26 of the cam housing and the other end bears against a washer 54, which is disposed about the connecting rod and held against the spring by a threaded fastening member 56. The valve housing 16 has an interiorly formed cylinder 58 therein. A piston 60 is slidably mounted within the cylinder and is connected to the connecting rod 52 by means of a cylinder rod 62 which extends through an armature 64 in the end wall 66 of the central housing 14. The cylinder rod is secured to the piston by means of a pin 68. The cylinder rod and connecting rod, in effect, comprises an elongated piston rod. To seal the cylinder 58 from the internal chamber 58 from the internal chamber 22 of the central housing, a bushing 70 is disposed about and held against the cylinder rod by a retaining member 72 which is mounted within a recessed area 74 at the rear end of cylinder 58. The bushing has a recessed area at the extended end thereof to accommodate a wiper 76 and a retaining ring 78 is carried by the other end of the bushing retainer. This assembly effectively seals the cylinder 58, which is filled with oil or other hydraulic fluid, from the interior chamber 22 of the central spring housing and supports the cylinder rod as the piston and cylinder rod reciprocates in the cylinder.

Means are provided for operably connecting the spring 50 to the spindle member 36 and as shown in the drawings, these means may include a pair of spaced carrier plates 80 and 82, each provided with a slot 84 and 86 within each of which is received the appropriate one of the shoulders 44 and 42. The connector rod 52 is secured to the carrier plates by means of a pin 88 which extends through the stepdown end 90 of the connecting rod. The carrier plates are further spaced by means of three cam follower rollers 92, 94 and 96. Roller 96, which will be referred to as the containment roller for reasons which will become apparent, is provided with a lower annular flange portion 98 to define a stepdown configuration. A main cam 100 is carried on the spindle member 24 between the shoulder portions 42 and 44; the cam having a cam surface 102 with a pair of oppositely disposed protuberances 106 and 108 thereon. A pair of lower recessed areas 110 and 112 are disposed below the protuberances to accommodate the stepdown roller 96, as will be described. A hold-open cam 114 is also carried on the spindle member 36 about cylindrical portion 116 thereof and between shoulder 44 and roller bearing 48. Hold-open cam 114 has a cam surface 118 with a pair of hold-open recesses 120 and 122 thereon, as shown in FIGS. 1, 4 and 6.

Figure 14:
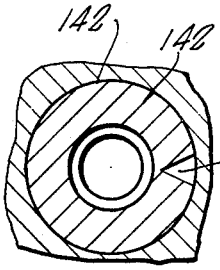
FIG. 14 is a sectional view of the "V" orifice taken along the lines 14—14 in FIG. 15.
Figure 15:
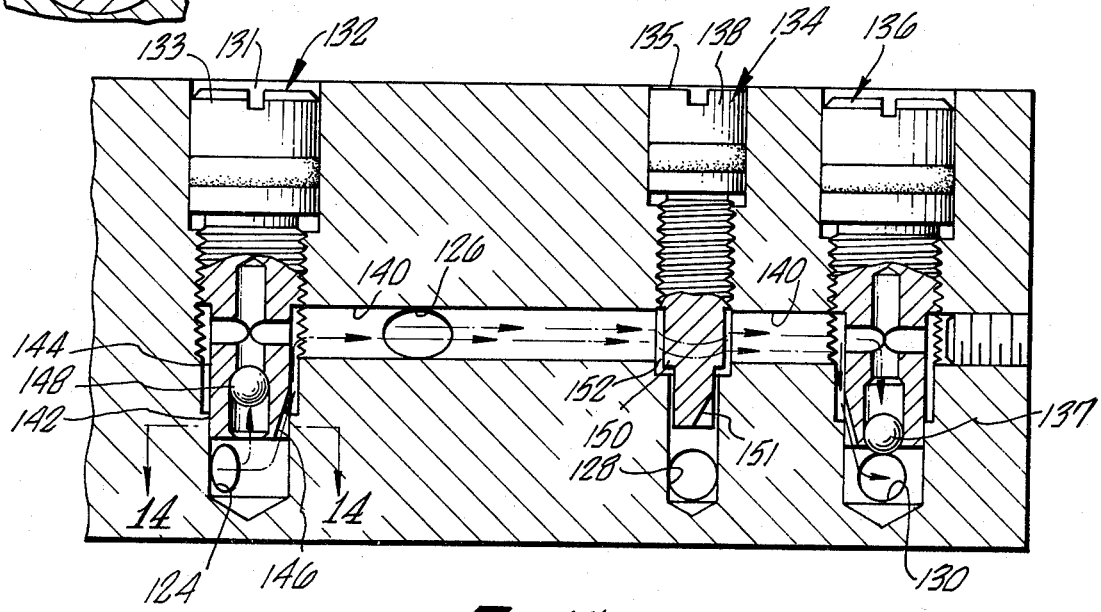
FIG. 15 is a sectional view of a portion of the door closer taken along lines 15—15 in FIG. 13.

Referring to FIGS. 11–15, valve means are provided for the hydraulic fluid which is held within cylinder 58 and, as shown in these figures, such means includes a plurality of ports 124, 126, 128 and 130 which are disposed within the valve housing 16 and communicate with and are axially aligned along the interior of cylinder 58; a plurality of valves 132, 134 and 136 and a connecting port or conduit 140. Port 124 communicates the cylinder 58 with valve 132, which as shown in FIGS. 14 and 15, includes a stem 142 working in a bore 144, the reduced end of the valve stem having a "V" groove 146 and valve ball 148. It can be seen that as fluid enters valve 132 through port 124, it passes through groove 146 in the valve stem, into bore 144 and on to conduit 140. Valve 136 is of the same construction as valve 132 and communicates port 130 with conduit 140 in the same manner as described above. Valve 134, which is disposed between valves 132 and 136, communicates port 128 with conduit 140 and comprises a valve stem 150 working in a bore 152. As can be seen in FIG. 15, fluid flow with conduit 140 is free to pass around the stem 150 within bore 152 and fluid flow entering the valve through port 128 passes through the groove 151 in stem 150 and into conduit 140. The functioning of these valves will be discussed further in relation to the operation of the door closer.

In use, the door closer 10 is rigidly mounted in the door frame, preferably in a concealed position in the header or overhead portion of the frame. The noncircular portion 36a of the spindle member 36 is connected to the door by inserting it into a mating aperture in the upper end of the door to form one of the door pivots, which is rotated by opening and closing the door in either direction. In the camming configuration shown in FIG. 1, the door (not shown) is in the fully closed position. In this orientation, the protuberances 110 and 112 on cam 100 abut cam follower rollers 92 and 94, thereby assuring proper alignment of the door in the closed position. As the door is opened (see FIG. 4), cam 100 is correspondingly rotated by spindle member 36 and camming surface 102 bears against follower roller 92, causing the carrier plates 80 and 82 to retract within the chamber 18 in the cam housing 12. It is understood that if the door were opened in a counterclockwise direction, as viewed from above in FIG. 1, the camming surface 102 would bear against follower roller 94 with a similar result. To avoid repetition, the following discussion will be limited to opening the door solely in the clockwise direction. Continued opening of the door and retraction of the carrier plates causes camming surface 102 to bear against containment roller 96. When the protuberance 108 on the camming surface reaches the containment roller, it is accommodated by the reduced diameter of the upper portion of the roller (see FIG. 5). As the door is opened wider and the cam 100 continues to bear against the follower roller 92, the containment roller 96 also continues to press against the cam to contain the door or prevent the door from being slammed closed after the protuberances 110 and 112 on cam 102 have cleared the cam follower rollers 92 and 94. Wear pads 154 and 156 are provided to prevent any excessive wear of the respective parts and a cushioning pad 157 is disposed within the cam housing rearwardly of the carrier plates and cams to cushion the rearward movement of the carrier plates against the rear wall of the cam housing upon abrupt opening of the door.

FIG. 6 illustrates the position of the cams 100 and 114 when the door has reached the fully open position. Carrier plate 80 has a pair of oppositely disposed upper cam follower rollers 158 and 160 mounted thereon. When the door reaches this position, one of these rollers, depending on the direction in which the door is opened, seats within either recess 120 or recess 122 in the camming surface of cam 114. As shown in FIG. 6, when the door is opened in a clockwise direction, the upper cam follower roller 158 seats within recess 120. It will be noted that the recess 120 is located on a portion of the cam surface having an over-center relationship with respect to the pivotal motion of the cam and that, because of this location, additional compression of spring 50, which occurs when carrier plates 80 and 82 retract within housing 12, with resultant axial movement of follower 158 is required to unseat the follower from its hold-open position. As noted above, if the door were opened in a couunterclockwise direction, cam follower 160 would engage in recess 122 to hold the door open in the other position.

Figure 12:
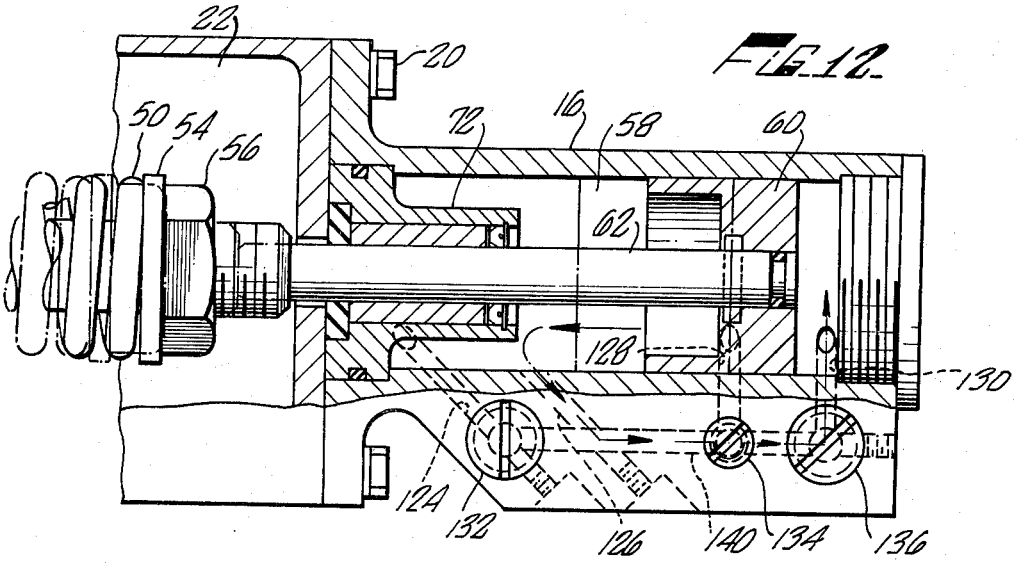
FIG. 12 is a sectional view of a portion of the valve closer illustrating the hydraulic fluid flow through the valve assembly as the door begins to open.
Figure 13:
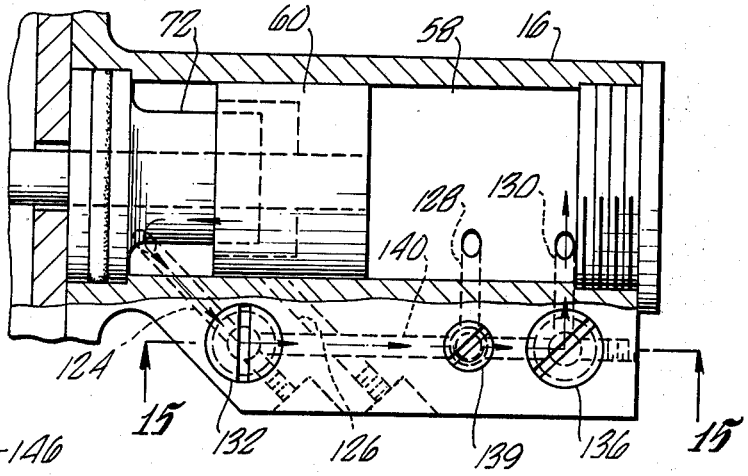
FIG. 13 is a sectional view of a portion of the door closer illustrating the hydraulic fluid flow through the valve assembly as the door is almost fully open.

Concurrently, with the above-described camming action, was the door is opened and the carrier plate retracts within cam housing 12, the piston 60 is correspondingly retracted within cylinder 58 by means of cylinder rod 62 and connecting rod 52. As the piston retracts within cylinder 58, the hydraulic fluid therein is forced to the rear of the piston, through ports 126 and 124, around valve 134, down through the bore in V-shaped groove of valve 136, through port 130 to the front of the piston, as seen in FIGS. 12 and 15. As the door is opened further and the piston is caused to retract further within the cylinder, port 126 is sealed by the piston forcing the fluid through port 124, to valve 132. The fluid is checked in valve 132 by the ball check 148 and is forced through the "V" groove orifice 146 into port 126 from where it follows the same path to the front of the cylinder as described above. Adjustment of valve 132, which is readily accomplished by inserting the end of a screwdriver or the like in slot 132 in the head 133 of the valve and turning the head which, due to the threaded engagement of the stem 142 with the valve housing, varies the size of the V-shaped groove 146, results in speeding or slowing of the door as the door is fully opened. Regulating this back checking of the door provides an adjustable shock absorber for the door as it reaches the fully open position. The door is then held in this position by the over-center relationship of recesses 120 or 122 as discussed above.

The door is easily closed by swinging it manually against the spring tension to clear the cam follower 158 out of the recess 120, whereupon the energy stored in the spring during the opening of the door is released to move the piston 60 and the connected carrier plates 80 and 82 to the right as seen in the drawings. Thus, the cam follower roller 92 bears against the camming surface 102 of cam 100, rotating the cam and its associated spindle member 36, forcing the door toward the closed position. In addition, camming surface 102 continually bears against the containment roller 96 which is carried by the carrier plates. The containment roller therefore contains or limits the rotational speed of the cam and therefore, the rate at which the door can close, to that dictated by the linear movement of the carrier plates. At the same time, the movement of the piston 60 to the right places the oil or other hydraulic fluid in the cylinder 58 under pressure. The fluid ahead of the piston is then forced through port 128, up through the adjustable "V" orifice in valve 134, into the connecting conduit 140, down through the "V" orifice 146 in valve 132, entering the cylinder 58 through port 124. Valve 134 can be adjusted in a similar fashion to valve 132 and it can be seen that regulating the size of the "V" orifice in valve 134 controls the closing speed of the door by regulating the rate of fluid flow therethrough.

Regulation of valve 134 is accomplished by rotation of the head portion 138 thereof, just as described above with respect to valve 132. As the piston proceeds forward, sealing port 128, the hydraulic fluid is then forced through port 130 into the bottom of valve 136 whereupon it is checked by valve ball 137, forcing the fluid through the adjustable "V" orifice therein into conduit 140, past valve 134 and through the "V" orifice 146 in valve 132, whereupon the fluid enters port 130 and exits to the rear of the piston. The restriction provided by the valves to this fluid flow constitutes a latch control and prevents the door from slamming shut. It can be seen that regulation of the "V" orifice in valve 136, which is accomplished in the same manner as with valves 132 and 134, provides control over the latching speed of the door, which is generally desired to be slower than the initial closing speed.

In addition to the above features, the door closer 10 also includes a means, illustrated in FIGS. 3 and 8–10, by which the door hold-open cam 114 can be circumvented to prevent the door from being held when it reaches the fully open position. This means includes a pair of oppositely disposed eccentric pins 170 (only one being shown) which extend through the carrier plates 80 and 82 and on which cam follower rollers 158 and 160 are mounted, as best seen in FIGS. 9 and 10. Because the two pins are identical, only pin 170 will be described herein, as that pin supports the roller 158 which operatively engages cam 114 when the door is opened in a clockwise direction, as illustrated in the drawings. An aperture 174 is disposed in the bottom of housing 12 below each pin to provide external access to a selector 176 which is disposed within aperture 178 in the lower carrier plate 82 and secured to the eccentric pin by a fastening pin 180. A coil spring 182 is disposed about the shaft portion of the eccentric pin 170 and is compressed between the head portion 185 of pin 170 ahd the selector 176 and urges the pin in a downwardly direction. The eccentric head of the pin has an enlarged portion 184 which is disposed within a recess of the follower roller 158 to restrain the vertical movement of the pin in the downward direction. The upper carrier plate 80 has an aperture 186 therein to accommodate the carrier plate and an elongated slot 188 which extends from opposite sides of the aperture to accommodate a protuberance 190 which extends from the lower portion of the eccentric head of pin 170. As shown in FIGS. 9 and 10, when the selector is pressed upwardly by a screwdriver or the like against the force of the biasing spring, the protuberance 190 is lifted from the slot in the upper carrier plate. Rotation of the selector causes the eccentric head to move to a retracted position, illustrated in FIG. 10. In the retracted position, the cam roller which is carried by the eccentric head is moved out of a line of engagement with the camming surface 116 of the hold-open cam 114. When the door is then moved to the fully open position, it is free to return to the closed position under the force of the coil spring 50, free of any restraint by the cam follower roller 158. It should additionally be noted that the force exerted by the spring 50 can be varied by rotation of the adjustment nut 56 which is threadably engaged with the connecting rod 52, as shown in FIG. 2.

FIG. 7 illustrates the door closer wherein the hold-open cam 114 described above is replaced with a hold-open cam 200 having a slightly different configuration. This cam is mounted in the same fashion as cam 114 and varies only in the positioning of the hold-open recesses 202 and 204 in the cam surface 206. These recesses are so disposed along the camming surface to hold the door open in a 105° disposition with respect to the door frame as opposed to the 90° disposition achieved with cam 114. It is, of course, to be understood that other variations in the positioning of the hold-open recesses and the hold-open cam can be utilized to retain the door at various angles with respect to the door frame.

Various other changes and modifications may be made in carrying out the present invention without departing from the spirit and scope thereof. Insofar as these changes and modifications are within the purview of the appended claims, they are to be considered as part of the invention.

We claim:

1. A door closer comprising a housing, a spindle member rotatably mounted in said housing for securing said closer to a door, a cylinder formed interiorly of said housing, a piston operable in said housing, means interconnecting said piston and said spindle member for movement of said piston upon rotation of said spindle member, and means for independently regulating the rate of closing and back checking the opening and latching of the door, said means including a plurality of valve means communicating with said cylinder for permitting a restricted flow of fluid about said piston as said piston reciprocates within said cylinder in response to the opening and closing of said door and means corresponding to the positioning of said piston within said cylinder for varying said restricted flow to correspondingly vary the rate of travel of said piston, said restricted flow varying means being operable at both ends of said cylinder and therebetween.

2. The combination of claim 1 wherein said restricted flow varying means comprises a plurality of ports disposed axially along said cylinder, one of said ports being disposed adjacent to each of said cylinder and communicating each said end with one of said valve means, at least one port being positioned between said inwardly disposed ports and communicating said cylinder with a third of said valve means, a conduit extending between each of said valve means and means for adjusting each of said valve means.

3. A combination of claim 2 wherein each of said valve means comprises a valve having a valve stem with a V-shaped groove therein operable to pass fluid therethrough and said valve stem is received in a bore, said ports and said conduit communicating with said bores.

4. A door closer comprising a housing, a spindle member rotatably mounted in said housing for securing said closer to a door, a cylinder formed interiorly of said housing, a piston operable in said housing, means interconnecting said piston and said spindle for movement of said piston upon rotation of said spindle member said means comprising a carrier plate slidably mounted within said housing about said spindle member, means connecting said plate to said piston, a first cam follower carried by said plate and a first cam carried by said spindle member, said cam having a cam surface engageable with said cam follower for linear movement of said plate and said piston upon rotation of said cam, biasing means for urging said plate toward said cylinder upon rotation of said spindle in a door opening direction, and means for independently regulating the rate of closing and back checking the opening and latching of the door, said means including a plurality of valve means communicating with said cylinder for permitting a restricted flow of fluid about said piston as said piston reciprocates with said cylinder in response to the opening and closing of said door and means corresponding to the positioning of said piston within said cylinder for varying said restricted flow to correspondingly vary the rate of travel of said piston, said resticted flow varying means being operable at both ends of said cylinder and therebetween.

5. A door closer comprising a housing, a spindle member rotatably mounted in said housing for securing said closer to a door, a cylinder formed interiorly of said housing, a piston operable in said housing, means interconnecting said piston and said spindle for movement of said piston upon rotation of said spindle member said means comprising a carrier plate slidably mounted within said housing about said spindle, a cam follower carried by said plate, a cam carried by said spindle member, said cam having a cam surface engageable by said cam follower and said surface having a hold-open recess therein, said recess being positioned on a portion of the cam surface having an over-center relationship with respect to the pivotal movement of the cam, biasing means for urging said plate toward said cylinder upon rotation of said spindle in a door opening direction, and means for independently regulating the rate of closing and back checking the opening and latching of the door, said means including a plurality of valve means communicating with said cylinder for permitting a restricted flow of fluid about said piston as said piston reciprocates within said cylinder in response to the opening and closing of said door and means corresponding to the positioning of said piston within said cylinder for varying said restricted flow to correspondingly vary the rate of travel of said piston, said restricted flow varying means being operable at both ends of said cylinder and therebetween.

6. The combination of claim 5 including means for positioning said cam follower out of a line of engagement with said cam surface to prevent the door from being held open thereby.

7. A door closer comprising a housing, a spindle member rotatably mounted in said housing for securing said closer to a door, a cylinder formed interiorly of said housing, a piston operable in said housing, means interconnecting said piston and said spindle for movement of said piston upon rotation of said spindle member said means comprising a carrier plate slidably mounted within said housing about said spindle member, means connecting said plate to said piston, a first cam follower carried by said plate, a first cam carried by said spindle member, said cam having a cam surface engageable by said cam follower and said surface having a hold-open recess therein, said recess being positioned on a portion of the cam surface having an over-center relationship with respect to the pivotal movement of the cam, a second cam follower carried by said plate, a second cam carried by said spindle member, said cam having a cam surface engageable by said second cam follower for retracting said plate within said housing upon rotation of said cam and means for independently regulating the rate of closing and back checking the opening and latching of the door, said means including a plurality of valve means communicating with said cylinder for permitting a restricted flow of fluid about said piston as said piston reciprocates within said cylinder in response to the opening and closing of said door and means corresponding to the positioning of said piston within said cylinder for varying said restricted flow to correspondingly vary the rate of travel of said piston, said restricted flow varying means being operable at both ends of said cylinder and therebetween.

8. The combination of claim 7 including spring means adapted to be compressed upon rotation of said spindle member in a door opening direction and urge said plate forward toward said cylinder.

9. The combination of claim 7 including a third cam follower carried by said plate for engagement with said cam surface on said second cam for restricting the closing movement of said door to the forward movement of said plate.

10. The combination of claim 7 including means for positioning said first cam follower out of a line of engagement with said camming surface on said first cam to prevent the door from being held open thereby.

11. The combination of claim 7 wherein said restricted flow varying means comprises a plurality of ports disposed axially along said cylinder, one of said ports being adjacent each end of said cylinder, communicating each said end with one of said valve means, at least one port positioned between said inwardly disposed ports and communicating said cylinder with a third of said valve means, a conduit extending between each of said valve means and means for adjusting each of said valve means.

12. A door closer comprising a housing, a spindle member rotatably mounted in said housing for securing said closer to a door, a cylinder formed interiorly of said housing, sealing means isolating said cylinder from said housing, a piston operable in said cylinder, means interconnecting said piston and said spindle member for movement of said piston upon rotation of said spindle member, said means including a carrier plate slidably mounted within said housing about said spindle member, means connecting said plate to said piston, a first cam follower carried by said plate and a cam carried by said spindle member, said cam having a cam surface engageable with said cam follower for retracting said plate within said housing upon rotation of said cam, spring means adapted to be compressed upon rotation of said spindle member in a door opening direction and urge said plate forward towards said cylinder, cam follower means for holding said door in an open position, means for rendering said hold-open means inoperative and valve means for regulating the rate of closing and back checking the opening and latching of said door.

13. The combination of claim 12 wherein said disengagement means comprises an eccentric pin carried by said plate, said pin carrying said cam follower means and being externally rotatable to move said cam follower means to an inoperative position.

14. The combination of claim 13 including means carried by said housing for cushioning the rearward movement of said carrier plate within said housing upon opening of said door.

15. The combination of claim 13 wherein said regulating means comprises a plurality of valve means communicating with said cylinder for permitting a restricted fluid flow about said piston as said piston reciprocates within said cylinder in response to the opening and closing of said door and means corresponding to the positioning of said piston within said cylinder for varying said restricted flow to correspondingly vary the rate of travel of said piston, said restricted flow varying means being operable at both ends of said cylinder and therebetween.

16. The combination of claim 14 wherein said restricted flow varying means comprises a plurality of ports disposed axially along said cylinder, one of said ports being disposed adjacent each end of said cylinder, communicating each said end with one of said valve means, at least one port positioned between said inwardly disposed ports and communicating said cylinder with a third of said valve means, a conduit extending between each of said valve means and means for adjusting each of said valve means.

17. The combination of claim 14 wherein each of said valve means comprise a valve having a valve stem with a V-shaped groove therein operable to pass fluid therethrough and said valve stem is received in a bore, said ports and said conduits communicating with said bores.

18. The combination of claim 15 wherein said disengagement means comprises an eccentric pin carried by said plate, said pin carrying said cam follower means and being externally rotatable to move said cam follower means to an inoperative position.

19. A door closer comprising a housing, a spindle member rotatably mounted in said housing for securing said closer to a door, a cylinder formed interiorly of said housing, sealing means isolating said cylinder from said housing, a piston operable in said cylinder, means interconnecting said piston and said spindle member for movement of said piston upon rotation of said spindle member, said means including a carrier plate slidably mounted within said housing about said spindle member, means connecting said plate to said piston, a first cam follower carried by said plate and a cam carried by said spindle member, said cam having a cam surface engageable with said cam follower for retracting said plate within said housing upon rotation of said cam, biasing means for urging said plate toward said cylinder upon rotation of said spindle in a door opening direction, and valve means for independently regulating the rate of closing said door, back checking the opening of said door and latching of said door.

* * * * *